US005957238A

United States Patent [19]

Curvin, II

[11] Patent Number: 5,957,238

[45] Date of Patent: Sep. 28, 1999

[54] TOOL TRAY FOR LADDERS

[76] Inventor: Richard A Curvin, II, 421 N. Hicks Rd. Apt. 2, Palatine, Ill. 60067

[21] Appl. No.: 09/012,172

[22] Filed: Jan. 23, 1998

[51] Int. Cl.[6] ..... E04G 1/00

[52] U.S. Cl. ..... 182/129; 248/210; 248/211; 248/238

[58] Field of Search ..... 182/129, 116, 182/120; 248/210, 211, 238; 211/88.01, 126.1; 15/257.06; 220/485, 491, 570; D32/53.1

[56] References Cited

U.S. PATENT DOCUMENTS

| | | | |
|---|---|---|---|
| 966,244 | 8/1910 | Ruck | 248/238 |
| 1,633,112 | 6/1927 | Kulbeck | 182/129 |
| 1,645,879 | 10/1927 | Skeels | 248/238 X |
| 2,252,025 | 8/1941 | Olson | 248/238 X |
| 2,318,930 | 5/1943 | Dietrich | 248/210 X |
| 2,444,096 | 6/1948 | Faust | 220/570 |
| 2,887,705 | 5/1959 | Serwer | 220/570 X |
| 3,032,203 | 5/1962 | Romero | 220/491 X |
| 3,051,428 | 8/1962 | Schult | 248/210 |
| 3,082,879 | 3/1963 | Wilson | 220/491 X |
| 3,088,598 | 5/1963 | Werneke | 211/88.01 |
| 3,490,558 | 1/1970 | Foley | 182/129 X |
| 3,647,077 | 3/1972 | Gillespie | 220/485 X |
| 3,829,051 | 8/1974 | Emmons | 248/238 |
| 3,887,073 | 6/1975 | Wilson | 220/485 X |
| 4,343,405 | 8/1982 | Virte et al. | 211/88.01 |
| 4,646,878 | 3/1987 | Moyer | 248/238 X |
| 4,826,075 | 5/1989 | Burns | 211/88.01 X |
| 4,991,808 | 2/1991 | LaChance | 248/211 |
| 5,052,581 | 10/1991 | Christ et al. | 248/211 X |
| 5,379,536 | 1/1995 | Lorenzana | 220/485 X |
| 5,390,443 | 2/1995 | Emalfarb et al. | 211/88.01 X |
| 5,431,249 | 7/1995 | Tredup | 182/129 |
| 5,641,142 | 6/1997 | Hanson et al. | 182/129 X |

*Primary Examiner*—Daniel P. Stodola
*Assistant Examiner*—Richard M. Smith
*Attorney, Agent, or Firm*—Paul H. Gallagher

[57] ABSTRACT

A one-piece, integral device made up of linear rods and having a basket portion and a hook portion, the latter for mounting it on a step ladder. The basket holds an ordinary tool box. Also the basket portion has side hooks for mounting extra tools and instrumentalities.

13 Claims, 2 Drawing Sheets

TOOL TRAY FOR LADDERS

FIELD OF THE INVENTION

The invention covers a device or tray for fitting on a step ladder, by a workman in the construction field, for holding tools and other items for easy access to the workman while he is standing on the ladder. The device is securely held on the step ladder and the workman need not pay attention to the securement of the tray or any of the tools, but only to the immediate work he is performing and the tool used therefor.

SUMMARY OF THE INVENTION

The device of the invention possesses various features and advantages as follows:

1. It is extremely simple and easily manipulated or handled. It can be mounted on the step ladder very easily and quickly.

2. It is made of one piece, and therefore is easily applied to the step ladder and removed therefrom, and the tool box which it is designed for holding, can be easily fitted in the device and removed therefrom.

3. Because of its simplicity, it is very inexpensive to manufacture, both in the cost of the elements and the fabrication thereof.

4. Because of its one-piece construction it is adapted to molding of plastic, and simplifying its fabrication.

5. It has effective means for securely holding it on the ladder against accidental dislodgement.

6. It includes constructional elements facilitating holding, on its exterior, articles other than tools, such as a blow torch, not conveniently held in a tool box.

7. The device is non-collapsible and therefore devoid of danger of accidents from that source.

8. The device is of such construction that a plurality of them can be easily stacked.

BRIEF DESCRIPTION OF THE INDIVIDUAL FIGURES OF THE DRAWINGS

DETAILED DESCRIPTION OF THE DRAWINGS

Referring in detail to the drawings, the device or tray is shown in its entirety at 16 mounted on a step ladder 17 (FIG. 2) of known kind. The device includes as its main components a basket or basket portion 18 and a main hook or main hook portion 20.

Figure 2:
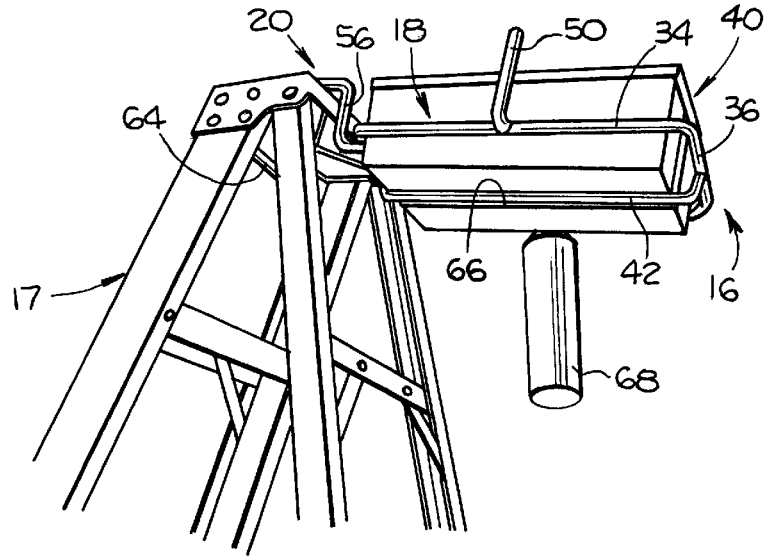
FIG. 2 is a perspective view of the device mounted on a step ladder, and holding a tool box.
Figure 3:
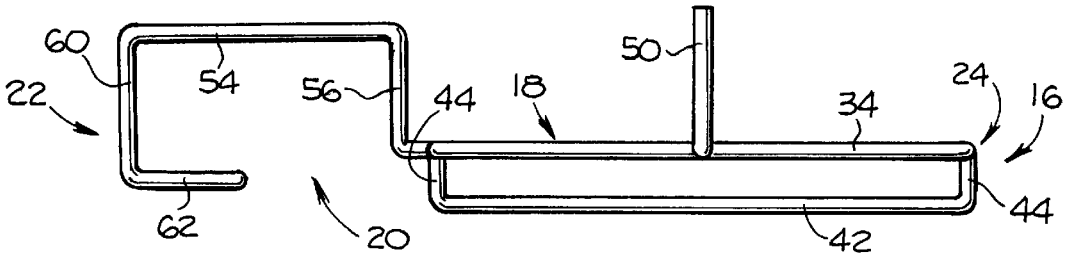
FIG. 3 is a side view of FIG. 1.
Figure 4:
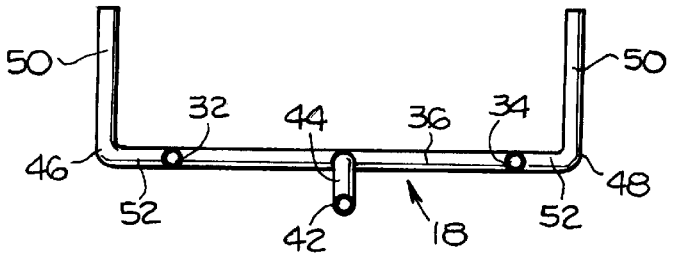
FIG. 4 is a view taken at line 4—4 of FIG. 1.
Figure 5:
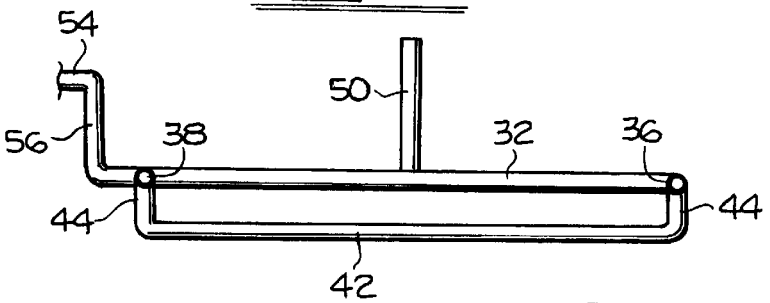
FIG. 5 is a view taken at line 5—5 of FIG. 1.

The entire device is of one-piece construction and is made up entirely of rods forming linear elements, and elbows between adjacent rods. For convenience the device is referred to as having an inner end 22 and an outer end 24, corresponding to its mounting on the step ladder 17, as seen in FIG. 2, wherein the hook 20 is hooked on the top step of the ladder, and the outer end 24 extends outwardly or forwardly from the ladder.

The step ladder 17 has a top step 28 which is flat and horizontal when the ladder is in open, standing position, and the hook 20 is dimensioned for releasably hooking on the top step as will be referred to again hereinbelow.

The basket 18 includes a surrounding rectangular frame 30 which includes side rods 32, 34, an outer end rod 36 and an inner end rod 38, all lying in a common plane. The particular shape is not essential, but is preferably elongated to accommodate a very common form of tool box, identified 40. When the device is mounted on the ladder, it is essentially horizontal, and the following description is made in accordance with that orientation.

The basket portion includes a central longitudinal rod 42 having upwardly extending terminal elements 44 secured to the end elements of the frame. This rod 42 is below the frame a convenient extent accommodating the conformation of the tool box as referred to below.

Secured to the side rods 32, 34 are auxiliary hooks 46, 48, each of which has a vertical post 50 and a bottom horizontal element 52 secured to the corresponding side rod. These hooks therefore are positioned laterally outwardly beyond the side rods 32, 34.

The main hook 20 includes transversely spaced, longitudinally extending top rods 54, gripping the top step on the ladder at side positions for providing stability. At the outer end of the rods 54, are downwardly extending rods 56, at the lower end of which are horizontal elements 58 secured to the inner end rod 38. The vertical elements 56, and thus the main hook portion, are spaced inwardly from the rod 38, and thus from the basket, which enables stacking, as referred to below.

At the inner end of the rods 54 are inner vertical rods 60, and at the lower ends of the latter are horizontal rods 62, the other ends of which are interconnected by a transverse horizontal rod 64. The rods 62, 64 together form a terminal main hook member which, according to the overall orientation of the device, extends toward the basket, i.e. to the right (FIG. 1), and is preferably substantially in the same plane as that of the frame 30.

The device is applied to the step ladder, when the ladder is in spread, standing position by hooking the terminal main hook member 62, 64 under the inner edge of the top step and the device then is moved or shifted outwardly, and the basket portion let down so that the top rods 54, at their outer end, rest on top of the top step. The device is then held in cantilever position, with the terminal main hook portion 62, 64 bearing upwardly on the inner edge of the top step. The remainder of the device, forwardly, is unsupported except from the main hook member. The vertical rods 56, 60 engage the ladder step and prevent dislodgement of the device in horizontal direction.

The tool box 40 as here shown, has a suitable length and depth. It has a solid bottom and a longitudinal groove 66 in its under surface, extending the length of the box.

The basket is dimensioned to hold the tool box within the frame 30, the peripheral side and end rods 32, 34, 36, 38 confining the box against lateral displacement, the box resting on the bottom rod 42, this rod being received in the groove 66 of the tool box.

The depth of the bottom rod 42, as determined by the vertical elements 44, need not be deep; this rod reduces any danger of the box to fall or to be tilted out of the basket portion.

The auxiliary hooks 46, 48 enable the user to hang other tools or instrumentalities thereon, such as a blow torch 68 shown in FIG. 2. Other instruments may be held thereon, as may be desired, such as a nail bucket. As was stated above, the hooks are set out from the side bars to facilitate hanging the tools thereon.

Figure 1:
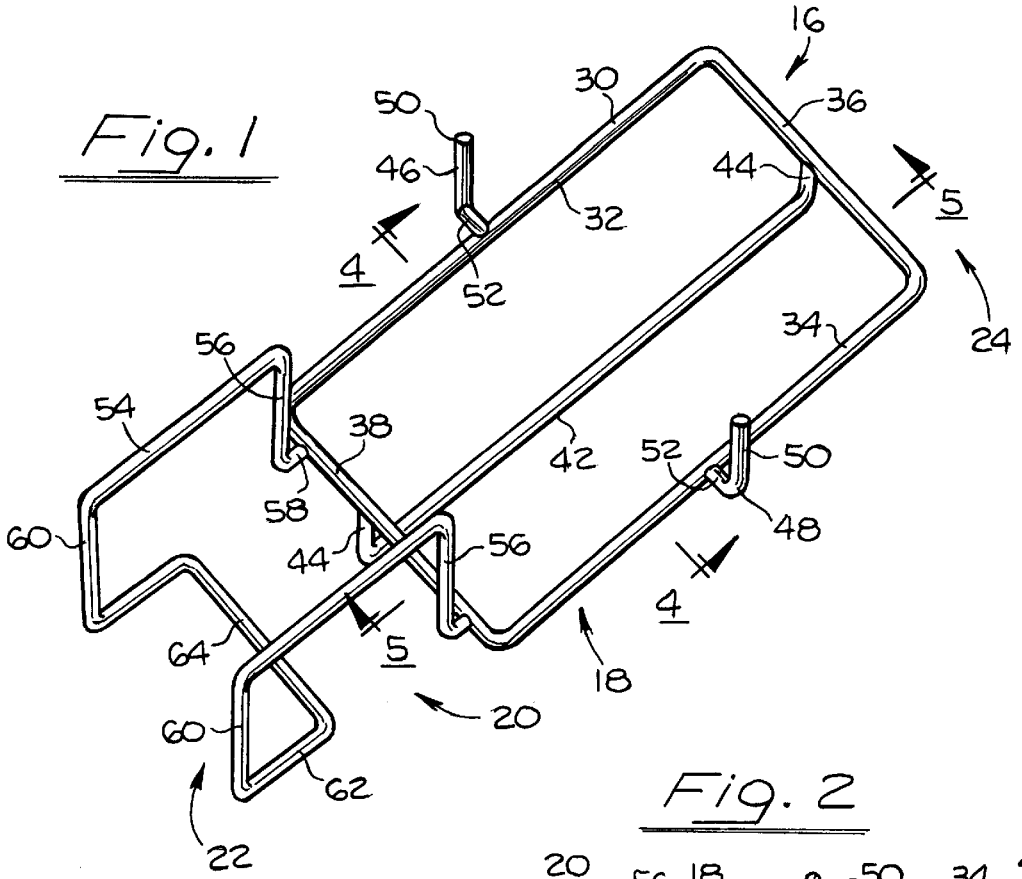
FIG. 1 is a perspective view of the device of the invention.

For using a single device, the hooks 46, 48 may be located at any position along the length of the frame 30, and in FIG. 1 they are shown about midway. However, it is desired that a plurality of empty devices be stacked when not in use.

Figure 9:
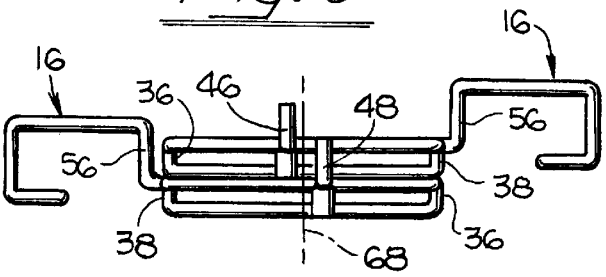
FIG. 9 is a side view showing a plurality of the devices in stacked form.
Figure 6:
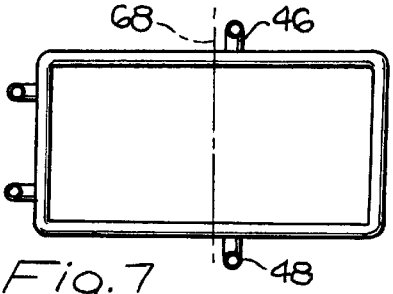
FIG. 6 is a top view of the basket portion of the device, showing external hooks in a first position.
Figure 7:
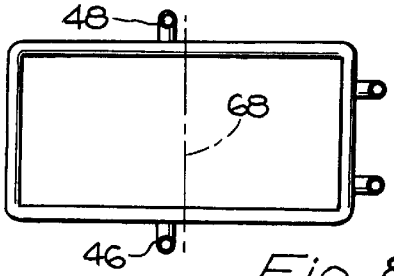
FIG. 7 is a view similar to FIG. 6 but showing the hooks in another position.

Attention is directed to FIG. 9, showing two devices in stacked position. The devices are positioned alternately end-to-end, with the baskets aligned vertically. The vertical rods 56 are inwardly of the end rod 38 of the frame as stated, and the devices are stacked so that the outer end rod 36 of each is vertically aligned with the inner end rod 38 of the adjacent one below, and thus horizontally spaced from the vertical rod 56. However, for such stacking, the auxiliary hooks 46, 48 instead of being located on a common transverse axis at the center, are located on a transverse axis displaced from the center, as shown in FIGS. 6, 7, so that in stacked position they are successively offset.

Figure 8:
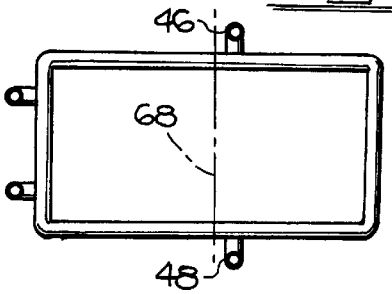
FIG. 8 is a view similar to FIGS. 6 and 7 showing the hooks in a third position.

It is also feasible, to have the auxiliary hooks 46, 48 staggered, relative to their positions in a single device, as represented in FIG. 8. In this case the devices can be stacked without interference between any of the hooks.

Figure 10:
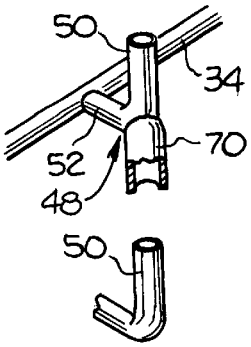
FIG. 10 is a fragmentary view showing a modified detail construction.

An alternate construction for accommodating stacking is represented in FIG. 10. It is recalled that the middle bottom rod 42 is located below the frame 30, and being of the same length as the frame, the bottom rod must remain on top of the frame of the device below, resulting in an unstable position. To compensate for this, a short sleeve or tube 70 is secured to the lower end of each auxiliary hook 46, 48, which telescopes over the hook below, to provide stability.

All of the rods together form a one-piece construction. The entire device is rigid, and can be easily held and manipulated. There are no moving parts, and no attachments to it that would interfere with the mounting of the device on the ladder. It is of extremely simple construction, rendering it inexpensive both in the materials used in making, and the fabrication thereof.

In the case of using plastic material as in a molded device, it may be of convenient shape, in cross-section, to provide greater strength where needed in the construction.

I claim:

1. A tool tray for mounting on a step ladder having a top step with a front side and a rear side and having a broad top surface disposed horizontally when the ladder is in open and operable position, comprising, an integral, one-piece device having a longitudinal direction and with ends and sides, the device having an outer end and an inner end, and including a basket at the outer end and a main hook at the inner end, and the device being made up entirely of the basket and main hook, the device being capable, together with other identical devices, of forming a stack with the baskets in a vertical tier, the device oriented substantially 180 degrees relative to adjacent devices when stacked, each basket including a polygonal loop and a single central bottom rod below the loop, the loop at each of two opposite sides having a hook member extending laterally outward from the loop, a socket extending downwardly from an end of said hook member distal from the loop, and a post extending upwardly from said hook member distal end, whereby the respective sockets and posts of adjacent devices operably interengage, and are operable for maintaining each two adjacent devices stable against the tendency of the basket to rock about the bottom rod.

2. A tray according to claim 1 wherein, the polygonal loop consists of two sides and two ends and comprises a single rod on each of the sides and ends.

3. A tray according to claim 2 wherein, said polygonal loop lies in a common horizontal plane.

4. A tray according to claim 3 wherein, the bottom rod is horizontal and is positioned below said plane.

5. A tray according to claim 2 wherein, the main hook includes longitudinally extending, transversely spaced elements mounted on a side of the loop that is positioned at the inner end of the basket, and the main hook also includes a transverse element interconnecting the inner ends of the transversely spaced elements.

6. A tray according to claim 5 wherein, each of the transversely spaced elements includes a top horizontal sub-element, a first vertical sub-element at the top sub-element's outer end, second vertical sub-element at the top sub-element's inner end, and a bottom horizontal sub-element at the second sub-element's lower end.

7. A tray according to claim 3 wherein, the first vertical sub-elements are spaced inwardly from the side of the loop that is positioned at the inner end of the basket.

8. A tray according to claim 6 wherein, the rod and loop form linear elements that are small in cross sectional dimensions relative to their lengths, and substantially uniform in cross sectional dimension throughout their lengths.

9. A tray according to claim 1 wherein, the posts lie in a common transverse vertical plane that is displaced laterally from the middle of the basket.

10. A tray according to claim 1 wherein, the posts lie in separate transverse vertical planes spaced apart longitudinally.

11. A tray according to claim 1 wherein, said sockets have stop elements capable of engaging the upper ends of the posts there below, for stabilizing the trays in the stack.

12. A tray according to claim 1 wherein, the tray is composed of molded plastic construction.

13. A tray according to claim 1 wherein, the device is made up entirely of linear elements and elbows, and each and all the elements and elbows are of substantially the same cross sectional dimension, and of such dimension uniformly throughout their lengths.

* * * * *